United States Patent [19]

Lenertz et al.

[11] 4,436,477

[45] Mar. 13, 1984

[54] QUICK ATTACHMENT CARRIER ASSEMBLY

[75] Inventors: John B. Lenertz, Carver County; Carroll E. Moore, Sibley County, both of Minn.

[73] Assignee: Farmhand, Inc., Hopkins, Minn.

[21] Appl. No.: 361,509

[22] Filed: Mar. 25, 1982

[51] Int. Cl.[3] ..... E02F 3/81

[52] U.S. Cl. ..... 414/723; 37/117.5

[58] Field of Search ..... 414/723; 37/117.5, 118 R; 172/272–275

[56] References Cited

U.S. PATENT DOCUMENTS

| | | | |
|---|---|---|---|
| 2,935,802 | 5/1960 | Wolfe et al. | 414/723 |
| 3,034,237 | 5/1962 | Wolfe et al. | 414/723 |
| 3,512,665 | 5/1970 | Westendorf | 414/723 |
| 3,606,052 | 9/1971 | Schury | 414/723 |
| 3,672,521 | 6/1972 | Bauer et al. | 414/723 |
| 3,964,622 | 6/1976 | Blair et al. | 414/723 |
| 3,985,249 | 10/1976 | Aker et al. | 414/723 |
| 4,085,856 | 4/1978 | Westendorf | 414/723 |
| 4,203,238 | 5/1980 | Bangert et al. | 414/723 X |
| 4,253,793 | 3/1981 | Braml | 414/723 |
| 4,297,074 | 10/1981 | Ballinger | 414/723 |

FOREIGN PATENT DOCUMENTS

| | | | |
|---|---|---|---|
| 43795/72 | 2/1974 | Australia | 414/723 |
| 1164323 | 2/1964 | Fed. Rep. of Germany | 414/723 |
| 2327946 | 5/1977 | France | 414/723 |

*Primary Examiner*—Robert J. Spar
*Assistant Examiner*—Terrance L. Siemens
*Attorney, Agent, or Firm*—Merchant, Gould, Smith, Edell, Welter & Schmidt

[57] ABSTRACT

A quick attachment carrier assembly (10) for releasably connecting an attachment (12) to a front end loader (14) comprises a pair of carriers (24) with top and bottom notches therein adapted to receive transverse pins (40, 42) on the implement. Pivotal hooks (46) are provided on the carriers (24) for engagement with the pins (42) for interconnecting the implement (12) to the loader (14). The latch hooks (46) are preferably secured together and controlled in common by means of a single lever (52) and plunger (56) which permit positive locking of both hooks in either the latched or unlatched positions.

2 Claims, 5 Drawing Figures

FIG. 1
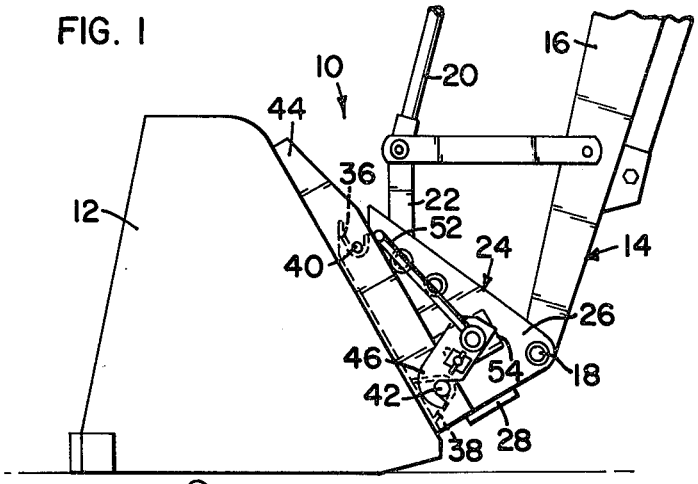
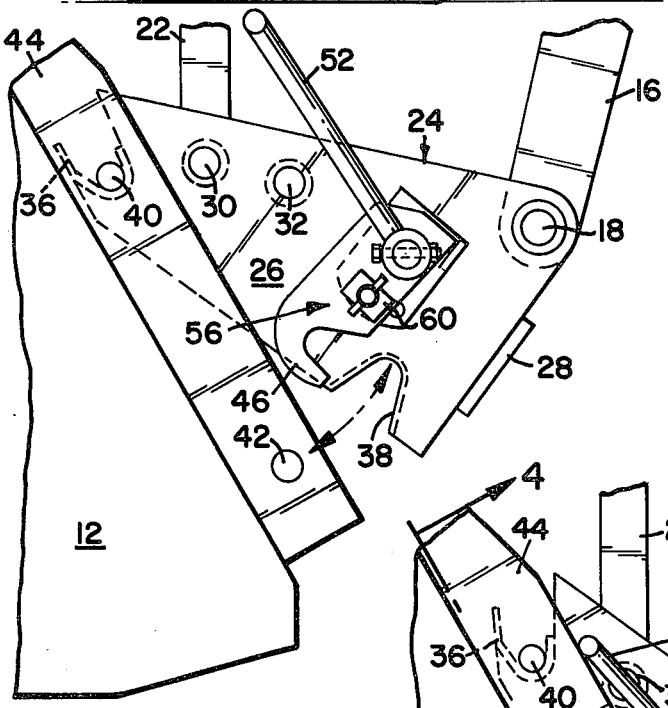
FIG. 2
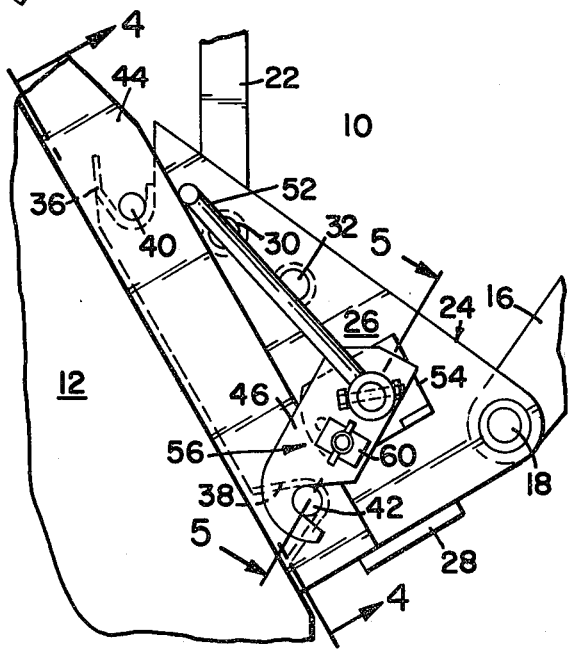
FIG. 3

QUICK ATTACHMENT CARRIER ASSEMBLY

TECHNICAL FIELD

The present invention relates generally to a quick attachment device, and more particularly to a carrier assembly for releasably and positively connecting an attachment, such as a bucket or the like, to the tilt cylinders and outer arms of a front end loader.

BACKGROUND ART

Tractors, skid steer loaders and other vehicles often carry loaders to which attachments can be connected for various material handling applications. Such loaders, which are usually mounted on the front ends of the vehicles, generally include a pair of laterally spaced side frames, an attachment mounted across the outer ends of the side frames, tilt cylinders coupled between the attachment and the side frames, and lift cylinders coupled between the side frames and fixed uprights by which the loaders are mounted on the vehicles. The lift and tilt cylinders are controlled by the operator of the vehicle to manipulate the attachment as desired.

Since a variety of attachments including scoops, blades, forks, grapples and baskets can be employed with front end loaders, it is desirable to provide a releasable attachment carrier assembly which is both quick and convenient to use. Any such assembly, of course, must be of strong and tight construction since it functions to distribute loads between the attachment and the loader frame; however, other features are also desirable. For example, it is advantageous for the carrier assembly to be configured to facilitate proper alignment and engagement with the attachment as the operator maneuvers the vehicle. Once engaged, it is also desirable to provide some means for quickly and positively locking the attachment to the carrier assembly and then securing the devices in locked relationship for safety purposes to prevent inadvertent disconnection during use.

The devices shown in U.S. Pat. Nos. 4,085,856; 3,964,622; 3,672,521; 3,512,665; 3,034,237 and 2,935,802 are representative of the prior art. U.S. Pat. No. 4,085,856 to Westendorf discloses a quick attach means for end loaders or the like comprising a vertical top pin and a spring loaded lower pin which is responsive to pivotal movement of the boom to automatically lock complementary vertical channel members. U.S. Pat. No. 3,964,622 to Blair, et al. shows a quick change mounting bracket for loader arms comprising a vertical shaft and locking plate which are normally spring biased to a locked position with respect to the lower transverse pin on the attachment. U.S. Pat. No. 3,672,521 to Bauer, et al. shows a quick attachment device, particularly adapted for use with skid steer loaders, which utilizes either pivotal hooks or axially movable wedge members to engage openings in a lower shelf member or lateral flange on the back side of the attachment. U.S. Pat. No. 3,512,665 to Westendorf also shows a quick attach means for end loaders comprising complementary V-shaped portions on the attachment and loader together with vertical top and spring loaded bottom pins for maintaining connection therebetween. Finally, U.S. Pat. Nos. 3,034,237 and 2,935,802 to Wolfe, et al. show multifunction attachment carriers of generally rectangular shape which are adapted to serve as the rear wall of the implement upon engagement therewith by means of pin and slot connections.

Thus, although various attachment carrier assemblies have been available heretofore, the prior devices have not been particularly convenient to use and have not provided adequately for either lateral alignment between the carrier assembly and the implement or positive interlock therebetween after connection. Except for the devices shown in the '521 Bauer and the '856 Westendorf patents, the devices exemplified by the patents discussed in the preceding paragraph require individual manipulation at each lateral side of the attachment. Moreover, the devices of the prior art have tended to be unnecessarily complex and thus expensive and difficult to maintain, and some of the devices incorporating spring secured locking means have tended to become inadvertently disengaged during use.

A need has thus arisen for an improved quick attachment carrier assembly of simplified construction whereby an attachment such as a front end loader can be brought into lateral alignment, connected and positively locked in place more conveniently and in less time than has been possible with the devices of the prior art.

SUMMARY OF THE INVENTION

The present invention comprises an improved quick attachment carrier assembly which overcomes the foregoing and other difficulties associated with the prior art. In accordance with the invention, carriers are secured to the side frames of the loader preferably by means of pivotal connections and tilt cylinders coupled between the carriers and the side frames. Each carrier includes a pair of vertically spaced apart notches adapted to receive transverse pins on brackets mounted on the attachment. The top notches of the carriers open generally upwardly while the bottom notches open generally forwardly toward the attachment. A pivotal hook is provided on each carrier adjacent to the lower notch thereof for movement between latched and unlatched positions relative to the corresponding pin, and means are provided for positively locking the hook in either the latched or unlatched position. The hooks are preferably interconnected by a common control shaft so that the hooks on both carriers can be actuated simultaneously through a single lever secured to one of the latches. The portions of the carriers defining the uppermost leading edges of the notches are preferably configured for selfcentering between the brackets on the attachment supporting the transverse pins in order to facilitate alignment during connection.

BRIEF DESCRIPTION OF DRAWINGS

A better understanding of the invention can be had by reference to the following Detailed Description in conjunction with the accompany Drawings, wherein:

FIG. 1 is a side view of a bucket mounted on a front end loader by means of the quick attachment carrier assembly of the invention;

FIG. 2 is an enlarged partial side view showing the attachment carrier assembly partially engaged with the bucket with the latch assembly in the unlocked position;

FIG. 3 is a view similar to FIG. 2, but with the carrier assembly fully engaged and the latch assembly in the locked position.

Detailed Description

Figure 4:
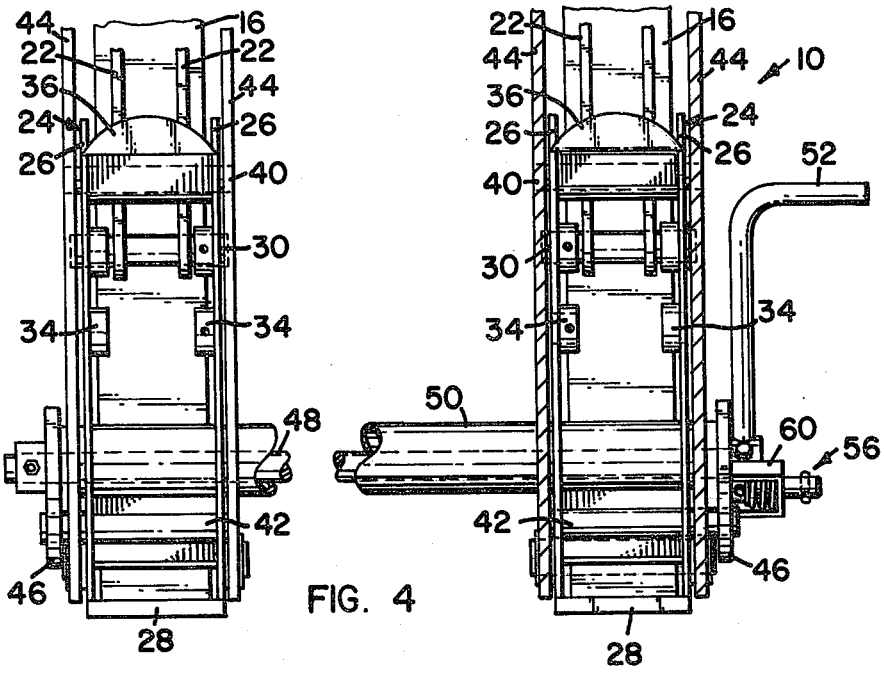
FIGS. 4 and 5 are sectional views taken along lines 4—4 and 5—5, respectively, of FIG. 3 in the direction of the arrows.

Referring now to the Drawings, wherein like reference numerals designate corresponding elements throughout the views, and particularly referring to FIG. 1, there is shown an attachment carrier assembly 10 of the invention interconnecting an implement or attachment 12 and a front end loader 14. Attachment 12 is shown in the form of a bucket, however, it will be understood that the carrier assembly 10 herein can be utilized with various types of implements including blades, forks, grapples, baskets and the like.

The front end loader 14 includes a pair of laterally spaced side frames comprised of inner or upper arms (not shown) and outer or lower arms 16 to the ends of which the carrier assembly 10 is connected by pivots 18. A pair of double acting cylinders 20 are coupled between the attachment carrier assembly 10 and outer arms 16 for effecting selective tilting of the attachment 12. As illustrated, each tilt cylinder 20 is connected to the attachment carrier assembly 10 by means of a toggle linkage including links 22, although the tilt cylinders can be coupled directly to the attachment carrier assembly if desired. The front end loader 14 can be of any suitable construction, such as that shown in U.S. Pat. No. 4,247,242 assigned to Farmhand, Inc., the disclosure of which is incorporated herein by reference. As will be explained more fully hereinafter, the attachment carrier assembly 10 provides a quick and convenient means for selectively connecting the attachment 12 to the front end loader 14, and for positively locking the two in mechanical engagement.

Figure 5:
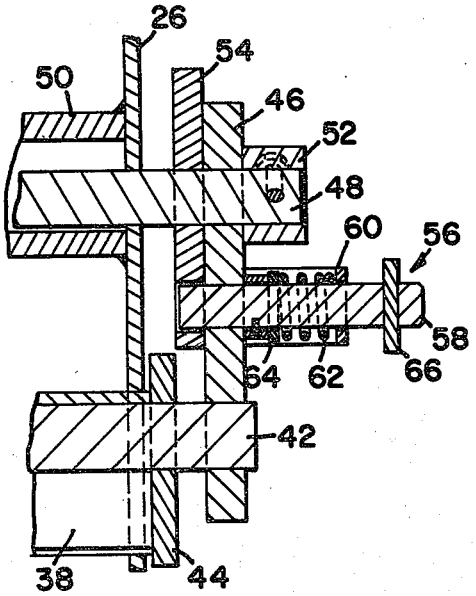

The constructional details of the attachment carrier assembly 10 are best seen in FIGS. 2–5, with FIGS. 2 and 3 being illustrative of the manner in which the assembly is connected and positively engaged with attachment 12. Referring first to FIGS. 4 and 5, the attachment carrier assembly 10 comprises a pair of laterally spaced apart carriers 24 each of which is of generally box-like construction consisting of vertical side plates 26 interconnected at their lower ends by a bottom plate 28. The ends of the arms 16 of the front end loader 14 fit between the side plates 26 of their corresponding carriers 24 and are secured thereto by pivots 18. The ends of one of the toggle links 22 likewise fit between the side plates 26 of their corresponding carriers 24 and are secured thereto by pivots 30. As illustrated, pivots 30 comprise pins extending through opposing locking collars and holes on the side plates 26 An additional pair of openings 32 and corresponding locking collars are provided on each carrier 24 for adjustability of the toggle links 22.

Each carrier 24 further includes a pair of transverse notches formed therein in vertically spaced apart relationship. The top notch opens generally upwardly and is defined in part by a first cross piece 36 of U-shaped cross section connected between the corresponding side plates 26. The bottom notch opens generally forwardly toward the attachment 12 and is defined in part by a second cross piece 38 secured between the corresponding side plates 26. In accordance with the preferred embodiment, the cross piece 36 defining the back end of the top notch preferably includes a rounded leading edge, as is best seen in FIG. 4, to facilitate alignment and engagement with the implement 12.

The notches on carriers 24 are adapted to receive transverse pins 40 and 42 extending between spaced apart brackets 44 welded or otherwise fixed to the back side of the attachment 12. Pins 40 and 42 and brackets 44 comprise the complementary portion of attachment carrier assembly 10 to which carriers 24 can be connected.

Referring again to FIGS. 4 and 5, a pivotal hook 46 is provided on each carrier 24 for movement between latched and unlatched positions relative to an extending end portion of the corresponding transverse pin 42 on the attachment 12. Hooks 46 can be independently pivotally secured to each carrier 24, however, in the preferred embodiment, the hooks are secured to opposite ends of a common shaft 48 extending through a tubular cross brace 50 secured between the carriers 24 for rigidity. A lever or handle 52 is attached to one end of the control shaft 48 for simultaneous actuation of bath hooks 46.

A latch plate 54 having a pair of holes corresponding to the latched and unlatched positions of hooks 46 is secured to the carrier 24 adjacent the handle 52, and a plunger 56 is provided on the corresponding adjacent hook for engagement with either hole in the latch plate in order to positively secure both hooks at once in either the locked or unlocked positions. The plunger 56 can be of any suitable construction, however, in the preferred embodiment, the plunger includes a locking pin 58 constrained by guide 60 for transverse movement relative to the latch plate 54. A compression spring 62 is positioned between guide 60 and a follower 64 on the locking pin 58 for normally biasing the pin toward the latch plate 54 and into one of the holes therein. A cross pin 66 is located at the outer end of the locking pin 58 so that an operator can manually disengage the plunger 56 as necessary to permit movement of hooks 46 between the latched and unlatched positions as desired by means of handle 52.

The preferred embodiment of the invention incorporates a pair of interconnected hooks 46 together with a single lever 52, latch plate 54 and plunger 56 on one end of the attachment carrier assembly 10 to save time and facilitate manipulation by the operator from one side only of the attachment 12; however, if desired, the common control shaft 48 can be ommitted with a separate lever, latch plate and plunger being provided for each hook on carriers 24 at either end of the assembly 10.

FIGS. 2 and 3 illustrate the manner in which the attachment carrier assembly carrier 10 is connected to the attachment 12 to effect connection with the front end loader 14. The tractor or other vehicle on which loader 14 is mounted is first driven up to the attachment 12, which would normally be resting on the ground. The lift and tilt cylinders of loader 14 are then manipulated, first to position the carriers 24 between brackets 44, and then to lift and tilt attachment carrier assembly 10 so that pins 40 are positioned within the top notches of the carriers 24 and the attachment 12 is supported on the assembly. It will be appreciated that the curved peripheral configuration of cross pieces 36 facilitates positioning of the attachment carrier assembly 10 between brackets 40 and thus lateral alignment relative to the implement. After the attachment 12 has been lifted slightly, the attachment carrier assembly 10 is pivoted backwardly by means of the tilt cylinders in order to position pins 42 in the bottom notches in carriers 24, following which the operator can dismount from the vehicle and manipulate the handle 52 and plunger 56 from one side of the attachment to move hooks 46 from the unlatched position in FIG. 2 to the latched position in FIG. 3 and thus positively secure the attachment to the loader 14. The reverse procedure is followed to disengage the attachment 12 from loader 16.

From the foregoing, it will be apparent that the present invention comprises an improved quick attachment carrier assembly having several advantages over the prior art. One advantage involves the fact that an implement can be secured to a loader by a direct mechanism latch which can be positively secured in either locked or unlocked positions. The two hooks comprising the latch assembly are interconnected and controlled simultaneously through a single lever and plunger from one side of the attachment. Other advantages will be event to those skilled in the art.

Although particular embodiments of the invention have been illustrated in the accompanying Drawings and described in the foregoing Detailed Description, it will be understood that the invention is not limited to the embodiments disclosed, but is intended to embrace any alternatives, equivalents, modifications and/or rearrangements of elements falling within the scope of the invention as defined by the following Claims.

We claim:

1. Apparatus for releasably connecting a material handling attachment to a loader, comprising:

a pair of laterally spaced apart upper transverse pins secured to the attachment;

a pair of laterally spaced apart lower transverse pins secured to the attachment beneath said upper transverse pins;

a pair of laterally spaced apart carriers secured to the front end loader, each carrier including an upwardly open top notch adapted to receive an upper transverse pin and a forwardly open bottom notch adapted to receive a lower transverse pin;

a hook mounted on at least one of said carriers for pivotal movement between a latched position in engagement with the corresponding lower transverse pin and an unlatched position;

handle means for manually actuating said hook between the latched and unlatched positions; and means for releasably locking said hook in either position;

said releasable locking means including;

a latch plate mounted on said carrier adjacent said hook with holes therein corresponding to the latched and unlatched positions of said hook;

a locking pin mounted on said hook for movement toward and away from said latch plate; and means for normally biasing said locking pin toward a locked position in registry with either hole in said latch plate.

2. Apparatus for attaching a front end loader to an attachment having laterally spaced apart vertical pairs of transverse pins mounted thereon, which comprises:

a pair of laterally spaced apart carriers pivoted to the front end loader, each carrier including an upwardly open top notch adapted to receive an upper transverse pin and a forwardly open bottom notch adapted to receive a lower transverse pin on the attachment;

a pair of hooks, one hook being pivoted to each carrier for movement between a latched position and in engagement with the corresponding lower transverse pin and an unlatched position out of engagement therewith;

means for rigidly interconnecting said hooks;

handle means for manually actuating said hooks in unison; and means mounted on one carrier for releasably locking said hooks in unison in either position;

said locking means including:

a latch plate mounted on said one carrier adjacent the corresponding hook with holes therein corresponding to the latched and unlatched positions of said hooks;

a locking pin mounted on said corresponding hook for movement toward and away from said latch plate; and means for normally biasing said locking pin toward a locked position in registry with either hole in said latch plate.

* * * * *